US005881686A

United States Patent [19]

Schmidt

[11] Patent Number: 5,881,686

[45] Date of Patent: Mar. 16, 1999

[54] CRANKCASE BREATHER VALVE FOR ENGINES WITH SYNCHRONOUS PISTON MOVEMENT

[75] Inventor: Gene Val Schmidt, Leduc, Canada

[73] Assignee: D.L.S. Cycle Products, Inc., Edmonton, Canada

[21] Appl. No.: 925,222

[22] Filed: Sep. 8, 1997

[51] Int. Cl.[6] ..... F01M 13/00

[52] U.S. Cl. ..... 123/41.86; 123/574

[58] Field of Search ..... 123/41.86, 574, 123/572, 573

[56] References Cited

U.S. PATENT DOCUMENTS

| | | | |
|---|---|---|---|
| 3,051,151 | 8/1962 | Hewlig | 123/41.86 |
| 4,169,432 | 10/1979 | White | 123/41.86 |
| 5,027,784 | 7/1991 | Osawa et al. | 123/572 |
| 5,067,449 | 11/1991 | Bonde | 123/46.86 |
| 5,205,243 | 4/1993 | Buchholz | 123/41.86 |
| 5,507,318 | 4/1996 | Israelson | 137/854 |

*Primary Examiner*—John T. Kwon
*Attorney, Agent, or Firm*—Sheridan Ross P.C.

[57] ABSTRACT

A crankcase breather valve for ventilation and pressure control within the crankcase of an internal combustion engine in which pistons stroke upwardly and downwardly in a synchronous movement. The valve is inserted into a breather hose which conducts gases into and out of the crankcase. The valve comprises a resilient valve member, preferably an elastomeric umbrella-type seal, spaced above a seal seat and forming a gap therebetween through which gases may flow either direction during portions of the pistons' stroke cycle. The valve construction permits three operating modes: firstly to permit the egress of positive pressure gas out of the crankcase and through the gap while the pistons stroke downwardly; secondly, to permit the ingress of a small amount of gas back through the gap into the crankcase when the crankcase pressure changes from positive to negative; and thirdly to check further ingress of gas into the crankcase at greater crankcase suctions, developed when the piston's are moving upwardly.

14 Claims, 5 Drawing Sheets

CRANKCASE BREATHER VALVE FOR ENGINES WITH SYNCHRONOUS PISTON MOVEMENT

FIELD OF THE INVENTION

The invention relates to the ventilation of a crankcase of an internal combustion engine and more particularly to the use of a valve to regulate the pressure therein.

BACKGROUND OF THE INVENTION

Internal combustion engines comprise pistons which reciprocate within cylinders. Up and down movement of the pistons is converted to a circular output motion through a crankshaft. The pistons are connected to the crankshaft with connecting rods. The crankshaft and connecting rods are housed in a crankcase. In operation, compressed combustion gases can leak past the pistons and enter the crankcase. These gases are normally referred to as "blow-by" gases. The crankcase is enclosed and thus accumulating blowby gases and the expansion of gases through heating can cause pressure to build up in the crankcase. Further, the gas-space in the crankcase is contiguous with the bore of the cylinders which is below the pistons. Up and down movement of the pistons within the cylinders varies the volume between pistons and the crankcase which can affect the pressure in the crankcase.

Conventional multi-cylinder engines use alternating piston movement, one piston rising while another descends, thus balancing the displaced volume and minimizing the variation in crankcase pressure.

Harley Davidson ("Harley") motorcycle engines have two cylinders and differ from conventional multi-cylinder internal combustion engines in that the two connecting rods run on a single crank. In other words, both of the pistons stroke upwardly together and stroke downwardly together synchronously. The piston movement is counterbalanced with two large crankshaft-mounted flywheels. Accordingly, on the downstroke, both pistons simultaneously move downward and diminish the volume available for the contained gases. The pistons compress the gases in the crankcase, pressurizing the crankcase gases to above atmospheric pressure ("positive" pressure). On the upstroke, both pistons simultaneously decompress crankcase gases, reducing the crankcase pressure to below atmospheric pressure ("negative" pressure). Accordingly, Harley engines produce large alternating positive and negative crankcase pressures.

Most visibly, high crankcase pressure is associated with leakage from crankcase seals.

On Harley engines produced earlier than 1993, the management of crankcase pressure is performed with a breather gear, driven and timed by the crankshaft. The gear is typically set to open and vent crankcase gases between 10° before top dead center (before TDC) through 75° after bottom dead center (after BDC). The breather gear vents crankcase gas to a separate camshaft chamber where the bulk of the oil mist is knocked out. The de-misted gas is then directed through a breather hose to the air cleaner. Due to the inherent physical limitations, the gear timing venting is not optimal at all engine speeds and throttle conditions. High crankcase pressures still result.

In another aspect, the oil system of Harley engines is also rather unique, being of the dry sump variety and having a separate oil tank. A scavenging pump collects oil from the bottom of the crankcase, routes it through an oil filter and on to an oil reservoir or tank. Oil flows under gravity feed from the oil tank to a feed pump which delivers oil to the engine components. Baffles in the camshaft chamber separate returning oil mist from crankcase gases before the oil collects at the scavenging pump. There are two aspects of this system which are sensitive to crankcase pressure. Firstly, excessive suction in the oil tank, the head space of which is in communication with the crankcase, adversely affects the supply of oil to the feed pump. Secondly, lack of a head of oil at the inlet of the scavenging pump and excessive suction in the crankcase can starve the scavenging pump of oil. In short, the excessive suction can result in oil-related engine failure.

In post-1993 Harley engines the breather hose has been relocated, from the crankcase, to each of the two rocker housings. Crankcase gases and pressure communicate with the rocker housings through the push rod tubes. A one-way check valve mounted within each rocker housing releases excessive crankcase pressure into the housing. The check valve is an "umbrella-type" valve having a port or ports blocked with an elastomeric umbrella valve head. The umbrella is normally closed over the port to prevent inflow of gases into the crankcase. Pressure flexes the umbrella off of the port so as to release gases from the engine. A small bleed hole is provided which permits collected oil to drain back to the crankcase. It is apparent that the bleed hole can also permit some gases to return to the crankcase. In the stock arrangement, a port directs the gases directly into the air cleaner. As an accessory, after-market cross-over tubing can be installed between the two rocker housings. A "tee" in the tubing directs the crankcase gases to a discharge tube and filter which removes oil mist.

Others have utilized crankcase breather valves in the context of conventional 4-stroke engines. The valves are known for reducing oil seal leakage by releasing excess pressure and forming a predominately negative pressure in the crankcase. Several breather valves use the "umbrella-type" valve heads ("umbrella"). For instance, in U.S. Pat. No. 5,067,449 to Bonde and U.S. Pat. No. 5,205,243 to Buchholz, disclose crankcase breather assemblies. An assembly is inserted into a port formed in the crankcase. The assembly incorporates an outer groove which retainably engages a lip formed in the port. The assembly further incorporates an umbrella which covers and seats over a circular array of ports. The umbrella is normally-closed so as to ensure only one-way flow through the ports. In U.S. Pat. No. 5,027,784, Osawa et al. improved the operability of an umbrella-type valve by interposing a washer between the umbrella and the ports. The washer reduces over-flexing and premature failure of the umbrella. Despite the presence of the washer, Osawa's umbrella still rests in the normally-closed position.

Thus check valves of the umbrella-type are known and they are all of the normally-closed, one-way variety. Accordingly, while these valves permit flow out of the crankcase on over-pressure, they do not permit any gas flow back into the crankcase, except for a small amount of sealing hysterisis.

While the synchronous piston movement in a Harley Davidson engine can benefit from a reduction of maximum crankcase pressure, it must do so while avoiding the creation of excessive crankcase suction which can be associated with loss of oil pump operation. Further, a device which meets the above objectives must do so without modification to the crankcase.

SUMMARY OF THE INVENTION

It has been determined that the pressure-related problems of the simultaneous upward and downward action of the pistons includes not only affects seal-leakage but also impacts on engine power. Further, direct application of conventional one-way flow check valves for releasing crankcase pressure results in undesirable side-effects, namely a loss of power at higher engine speeds and the formation of excessively high crankcase suction. Further, an external in-line device is preferred to avoid modifications to the engine crankcase.

More particularly, a device is provided which is inserted into the existing external breather hose. The device permits a small amount of gas flow back into the crankcase as the pressure in the crankcase begins to be drawn negative, thereby ultimately avoiding excessively high crankcase suction at the top of the pistons' stroke.

Thus, in a broad aspect of the invention a novel valve is provided for installation on an engine, such as a Harley Davidson motorcycle engine, which has two or more pistons which move simultaneously upwardly and simultaneously downwardly. The valve is installed on a breather hose extending from a port on the crankcase for discharge outside the crankcase. The valve is constructed such that it operates to control the flow of crankcase gases in three modes. Firstly, to permit the egress of positive pressure gas from the crankcase while the pistons are moving downwardly; secondly, to permit the ingress of a small amount of gas back into the crankcase when the crankcase pressure changes from positive to negative; and finally to check the further ingress of gas into the crankcase at greater crankcase suctions when the piston's are moving upwardly.

Preferably, the valve comprises the following construction for implementing the three operating modes. Firstly, the valve comprises an inlet, and outlet and a valve chamber intermediate the inlet and outlet. Within the valve chamber, a valve seat is formed at the discharge of the inlet to the chamber. A resilient member is spaced above the seal seat so as to form a gap through which gases may flow either direction. Accordingly, gas is able to flow from the inlet, past the member and on out of the valve's outlet. Under low pressure differentials across the member, gas will also flow back from the outlet, past the member, through the gap and out of the inlet so as to return to the crankcase. Under higher pressure differentials, the member flexes and blocks the seal seat, preventing further back flow from the outlet to the inlet and allowing the crankcase pressure to become negative.

More preferably, the resilient member is an elastomeric umbrella-type valve head, or a flexible reed.

DESCRIPTION OF THE PREFERRED EMBODIMENT

Figure 1:
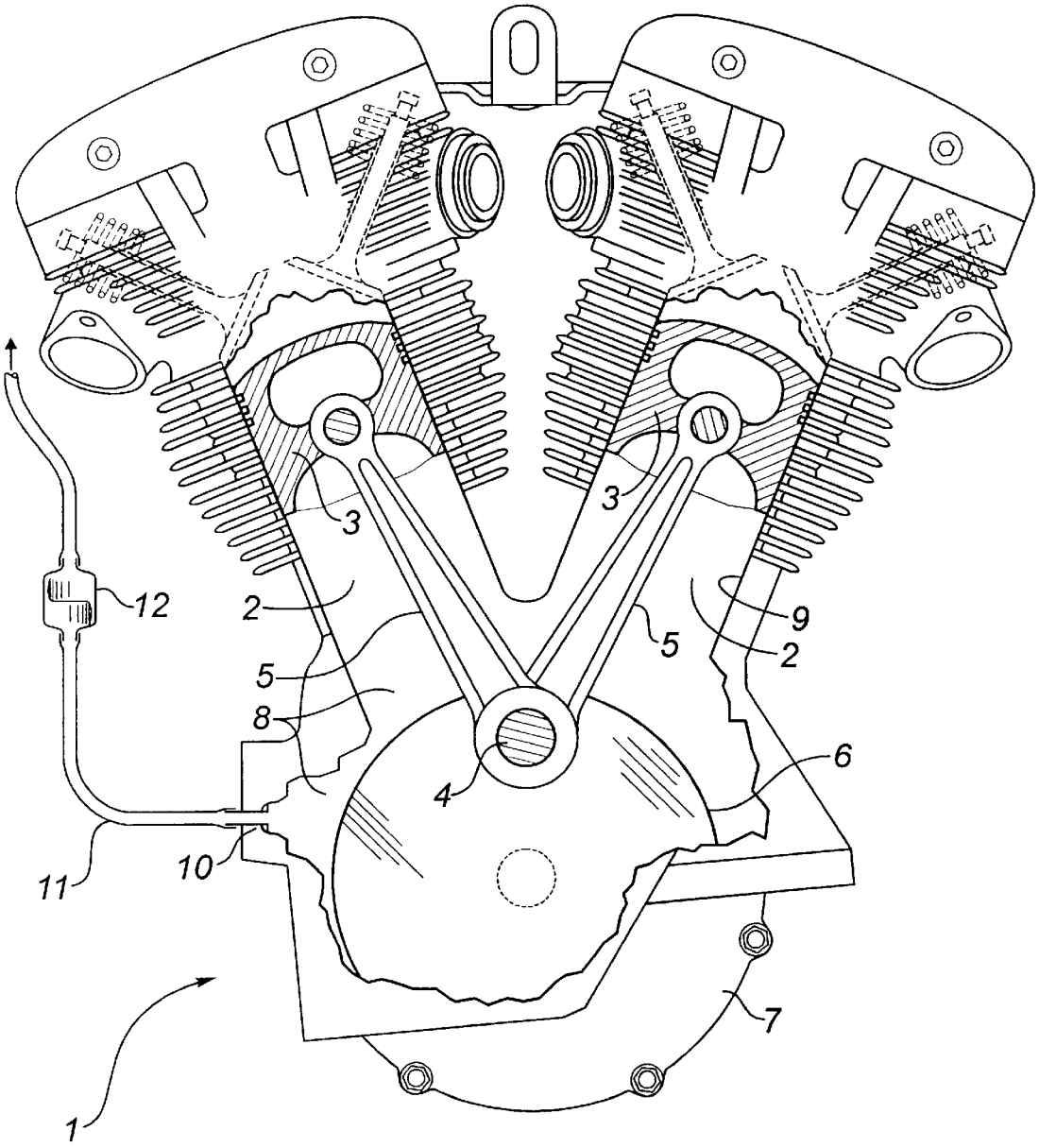
FIG. 1 is a simplified cross section of a pre-1993 Harley Davidson engine having a breather hose which is connected from the crankcase to the aircleaner. The figure further illustrates both pistons being simultaneously positioned at top dead center of their stroke.

Having reference to FIG. 1, a Harley Davidson ("Harley") engine 1 has two cylinders 2. Pistons 3 are connected to a crankshaft 4 with connecting rods 5. Both pistons 3 stroke upwardly together and stroke downwardly together within the cylinders 2. The movement of the pistons 3 is counterbalanced with two large crankshaft-mounted flywheels 6.

The crankshaft 4, flywheel 6 and connecting rods 5 are housed in a crankcase 7. The crankcase 7 forms a chamber 8 which is contiguous with bores 9 of cylinders 2. On the downstroke, both pistons 3 simultaneously move downward in cylinders 2, reducing the volume of the crankcase chamber 8 and raising its pressure to above atmospheric ("positive pressure"). On the upstroke, an increasing amount of the cylinder's bore 9 is exposed. This action increases the volume of the crankcase chamber 8, decompressing crankcase gases and reducing the crankcase pressure to below atmospheric pressure ("negative" pressure).

Port 10 is formed (via an oil pump housing disclosed below) in the crankcase 7. In conventional use, port 10 has a breather hose 11 connected for directing positive crankcase gases to an air cleaner 12 (FIG. 2).

Figure 2:
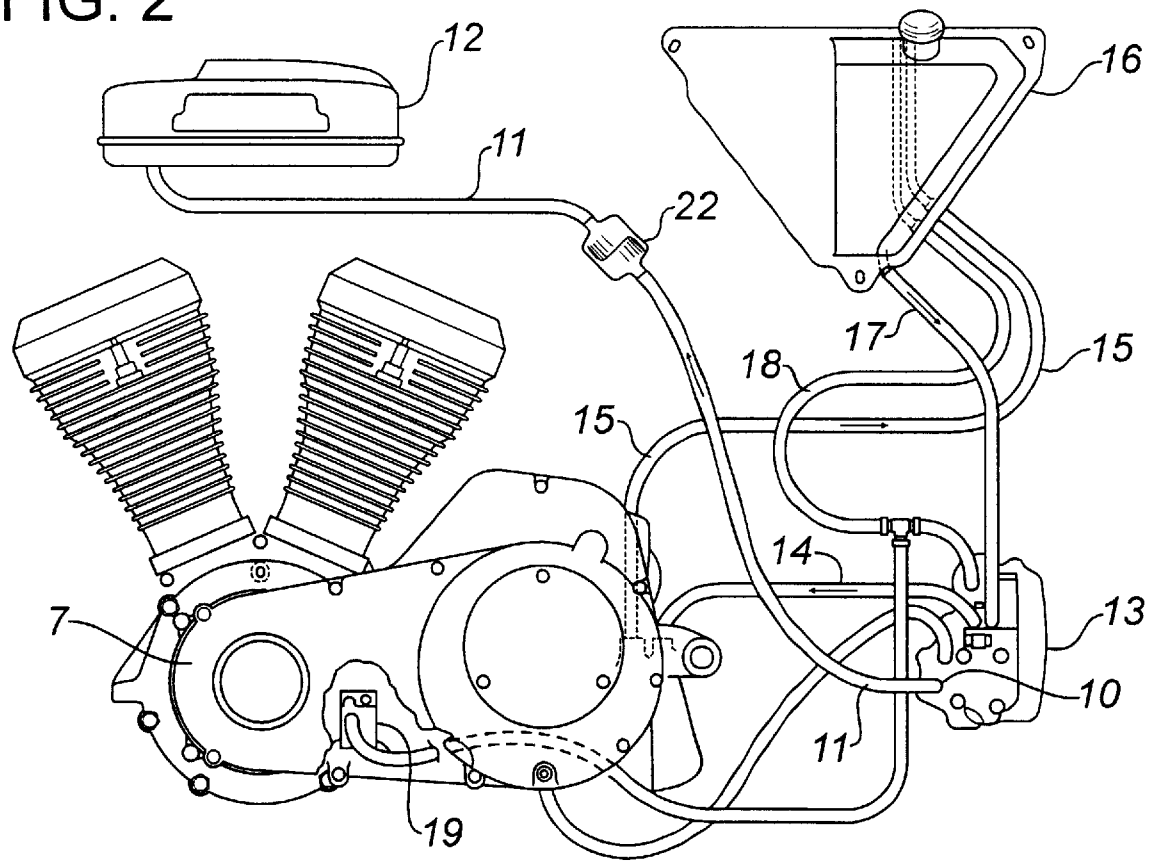
FIG. 2 is a flow diagram of the oil flow, the oil pumps and the crankcase venting system of the engine of FIG. 1.

Having reference to FIG. 2, the oil system is illustrated fancifully in a flow diagram format. An oil pump housing 13 is shown in a detached view from its normal attachment to the crankcase 7. A pair of gear pumps reside within the oil pump housing 13; a scavenger pump and a feed pump (not shown). The two pumps have oil flow systems which are maintained separate from each other. The scavenger pump receives oil directly from the bottom of the crankcase 7, routes it via hose 14 to an oil filter (not shown) and delivers it via hose 15 into an oil tank 16. Oil in tank 16 gravity flows through hose 17 as feed to the feed pump. The feed pump delivers oil through the crankcase to the engine components. Baffles within the crankcase separate returning oil mist from crankcase gases and the oil drains to the scavenging pump for completion of the oil system cycle.

As stated above, port 10 is connected to the air cleaner 12 via breather hose 11. The crankcase 7 is also vented through the oil pump housing 13 to the chain oiler 19 and to the oil tank 16 via hose 18. Thus, as the pressure changes in the crankcase 7, so does the pressure in the oil tank 16.

For implementing the present invention, a novel valve 22 (FIG. 2) is inserted into breather hose 11.

Figure 3:
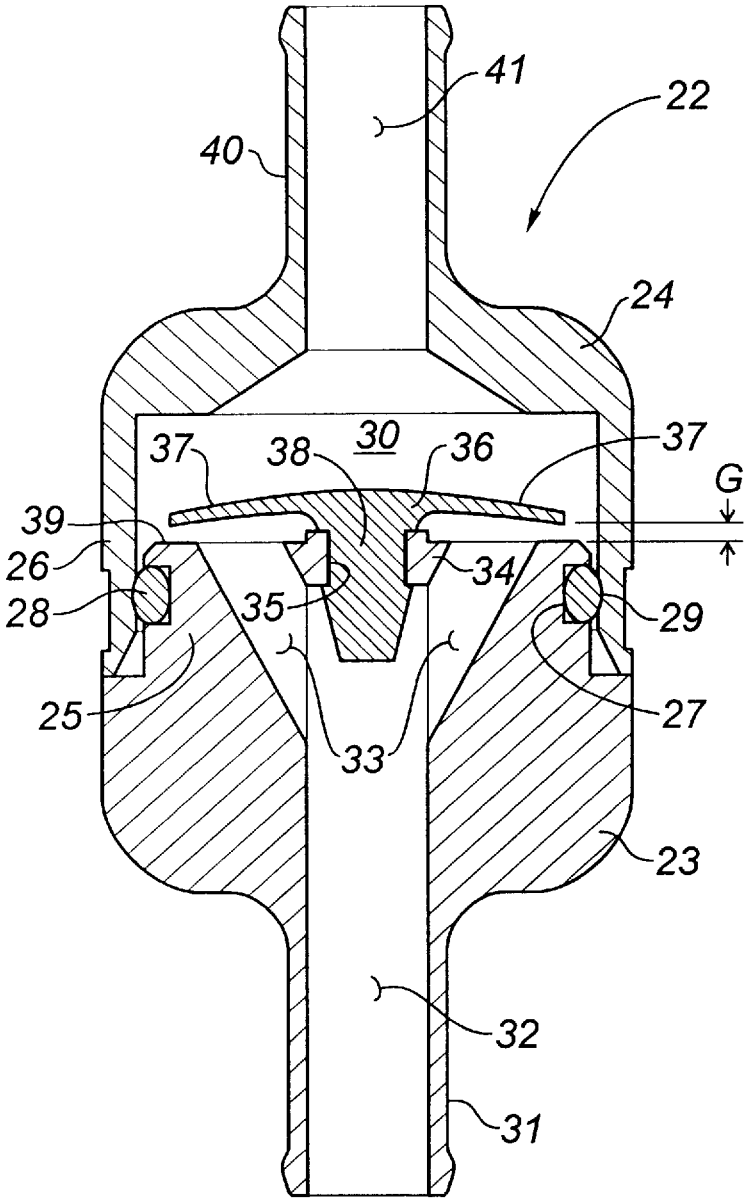
FIG. 3 is a cross section of the preferred valve of the present invention.

Having reference to FIG. 3, valve 22 is depicted in cross section. The valve comprises an inlet housing 23 and an outlet housing 24. The inlet and outlet housings 23, 24 have complementary mating ends 25 and 26 respectively. Mating end 25 has an external circumferential seal recess 27 bearing an O-ring 28. Outlet mating end 26 has an internal recess 29. When mated, external O-ring 28 engages internal recess 29, holding the two housings 23,24 together. Outlet housing 24 is cylindrical in form, having a cavity at its mating end 26 which forms chamber 30 when mated with the inlet housing 23. O-ring 28 seals chamber 30 from the atmosphere.

Inlet housing 23 has an inlet nozzle 31 opposite the mating end 25. A first passageway 32 is formed which extends through the inlet housing 23, from the inlet nozzle 31 to the mating end 25. At mating end 25, the first passageway 32 divides into a plurality of ports 33 distributed circumferentially about a central boss 34. The central boss 34 has a central opening 35. Within chamber 30, an elastomeric valve head 36 is located comprising an umbrella-shaped seal or "umbrella" 37 with a central and integral tang 38. The tang 38 fits into the boss's central opening 35 for securing the valve head thereto. A seal seat 39 extends circumferentially about the passageway ports 33. The height of boss 34 and the construction of valve head tang 38 cooperate to space the sealing periphery of umbrella 37 from seal seat 39, forming a gap G.

The outlet housing 24 has an outlet nozzle 40 opposite its mating end 26. A second passageway 41 is formed which extends through the outlet housing 34 from the nozzle 40 to chamber 30.

In operation, valve 22 permits three gas flow modes through port 10: gas flowing vigorously out of the crankcase 7; a small flow of gas into the crankcase; and no gas flow into or out of the crankcase.

In greater detail, in the first mode, upon the downstroke of the pistons 3, positive pressure is formed and forces crankcase gas out of crankcase port 10 and along the breather hose 11. The gases enter the inlet nozzle 31 of the valve 22, and are routed through the first passageway 32 to ports 33. The gases flow through the gap G. At high pressures and flows, the elastomeric umbrella 37 flexes even further away from the seal seat 39, permitting increased flow therethrough.

In the second mode, while the pistons 3 stroke upwardly, the pressure in the crankcase 7 diminishes from its previous positive pressure. Upon the crankcase pressure becoming negative, the flow of crankcase gases through the breather hose 11 reverses and begin to flow into the crankcase 7. Gas flows into the outlet nozzle 40 of the valve 22, is routed through the second passageway 41 and flows on into chamber 30. At low flows, the gases flow around umbrella 37 and through gap G.

In the third mode, as the pistons 3 continue to stroke upwardly, the differential pressure between atmosphere and the negative pressure in the crankcase 7 becomes so great that the umbrella 37 flexes to seal against the seal seat 39, blocking further flow therethrough.

Tests of the novel valve 22 were performed on a Harley Davidson motorcycle engine as illustrated in the following examples.

In each case, an engine was setup on a dynamometer ("dyno"). The dyno was equipped to measure horsepower (HP) and torque (ft-lbs). Pressure gauges were fitted to the crankcase and oil tank to measure peak positive and negative pressures. In Example 1, conventional engine arrangements and conventional one-way valves were tested as a baseline. In Example 2, testing was performed on a pre-1993 crankcase-breathing engine, and in Example 3 testing was performed on a post-1993, rocker housing breathing engine.

EXAMPLE 1

Early testing involved use of a conventional, one-way umbrella valve of the prior art. The prior art valve was inserted into the breather hose 11 of a pre-1993 Harley engine. This prior art valve did not permit any flow back into the crankcase 7 under negative pressure conditions. The results indicated little change in the engine performance through to 4000 rpm but at higher speeds there was a decrease in performance.

Further, at engines speeds of 1000–1500 rpm, pressure in the oil tank 16, normally being positive at about 0 to 2 in. Hg (all pressures are gauge pressure) dropped to a negative pressure of 1 to 4 in. Hg (vacuum), risking loss of oil pump prime and resultant engine failure. It became clear that application of the conventional one-way valve technology was not appropriate when applied to the peculiar characteristics of Harley engines.

Prior to conducting Examples 2 and 3 which follow, the significance of the spacing of the umbrella 37 from the seal seat 39 was investigated. Valve 22 was manufactured in accordance with the preferred embodiment. Inlet and outlet housings 23,24 were manufactured having an assembled cylindrical diameter of about 1.5 inches and a length of 1.5 inches. Inlet and outlet nozzles 31,40, each a further ¾ inches long, had inlet and outlet passages 32,41 having an inside diameter of 5/16 inches. A one inch diameter valve head 37, formed of nitrile, and having a 1/32 inch thick umbrella 37 was installed. The umbrella 37 is available from James Gaskets of Medesto, Cailf., Part No. 26856-89.

Six 3/16 inch diameter holes were drilled at about 45° angle to the inlet passageway 31, forming an array of ports 33 on the inlet housing's mating end 25. All ports 33 lay within the circumference of the umbrella 37 so that they could be sealed by the umbrella.

To properly set the gap G between the umbrella 37 and the seal seat 39, shims were successively applied between the umbrella tang 38 and the center boss 34 and the performance of the engine was re-tested.

Given the flexibility and the particular thickness of the given nitrile umbrella from James Gaskets, an optimal gap was G determined to be 0.030 inches with a maximum of about 0.045 inches. Beyond the maximal gap spacing, valve 22 permitted too much flow into the crankcase 7 to permit formation of a negative pressure.

Accordingly, for Examples 2 and 3 below, a valve 22 was provided in accordance with the preferred embodiment, particularly using the above-described nitrile umbrella 37 having a 0.030 inch spacing, as described above.

EXAMPLE 2

A pre-1993 Harley engine was tested on the dyno. Two arrangements were run: firstly using the conventional Harley or stock arrangement using a breather hose connected directly to the air cleaner; and secondly, using the novel valve 22 of the present invention, installed within the breather hose 11.

Figure 4:
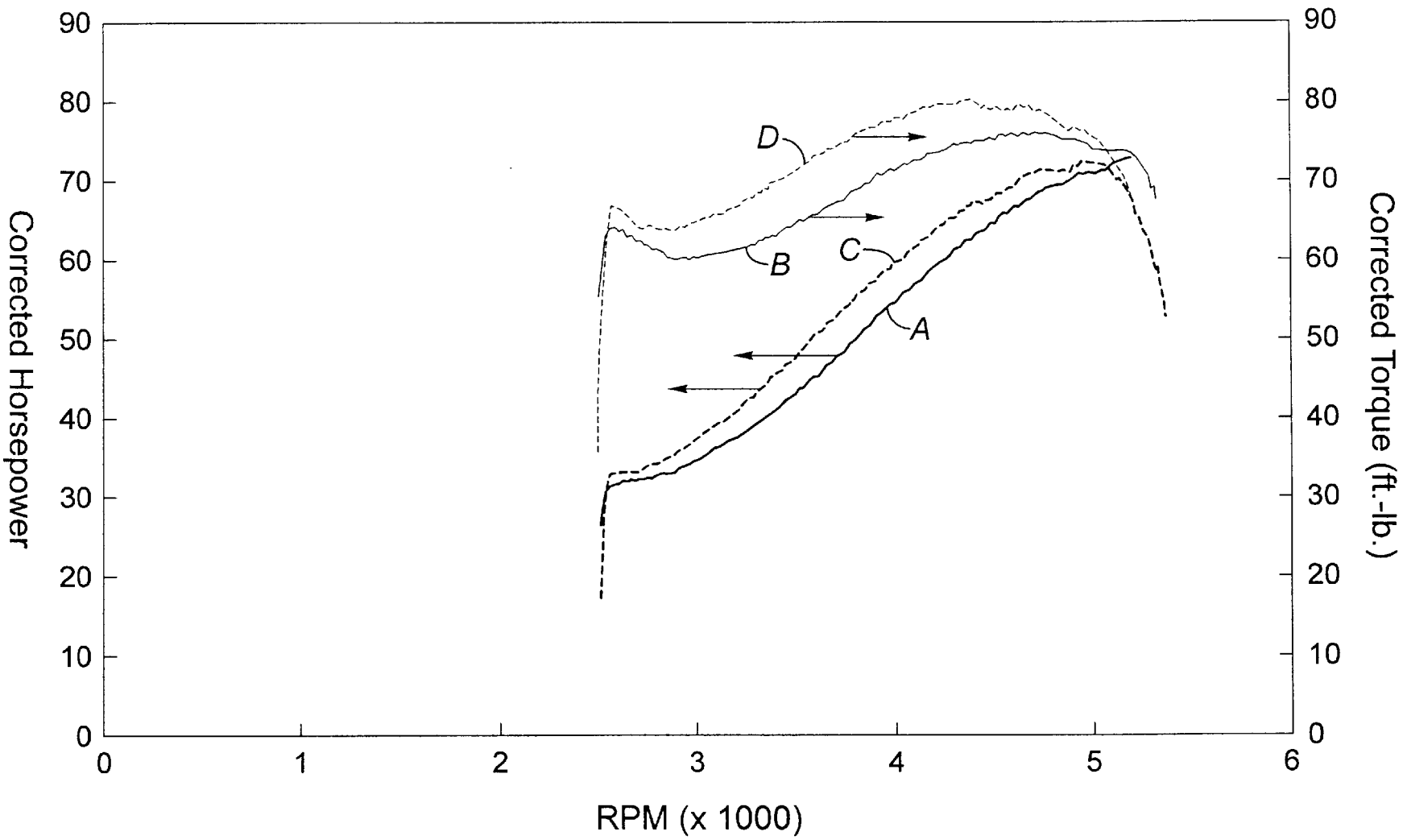
FIG. 4 is a chart illustrating the horsepower and torque output versus engine rpm for a pre-1993 Harley engine, with and without the apparatus of FIG. 3 installed.

Referring to FIG. 4, lines A and B illustrate the horsepower and torque performance, respectively, of the first, conventional engine arrangement. Lines C and D represent the respective horsepower and torque for the second arrangement implementing the present invention.

Reflecting on the horsepower results at 4000 rpm, line C represents a 9% increase in HP due to the addition of the novel valve. Further, increased power was obtained throughout the entire engine speed range up to 5000 rpm, the maximum safe operating speed for the engine. Corresponding increases were achieved in the torque.

Through observations made through clear tubing, and using the novel valve, oil pump prime was not compromised, despite oil tank pressures which measured from 0.5 to 2 in. Hg vacuum.

Using the conventional breathing arrangement, without a valve, pressures measured in the crankcase ranged from 5 to 6 in. Hg positive pressure (piston downstroke) and 5 to 6 in. Hg negative pressure (piston upstroke). Upon installing the novel valve, the pressures ranged from 2.5 to 3 in. Hg positive pressure and 7.5 to 8 in. Hg negative pressure.

Further, crankcase oil seal leakage was virtually eliminated.

EXAMPLE 3

A post-1993 engine was tested on the dyno. Again, two arrangements were run: firstly using the conventional arrangement using solely a breather hose; and secondly, using the novel valve of the present invention.

Figure 5:
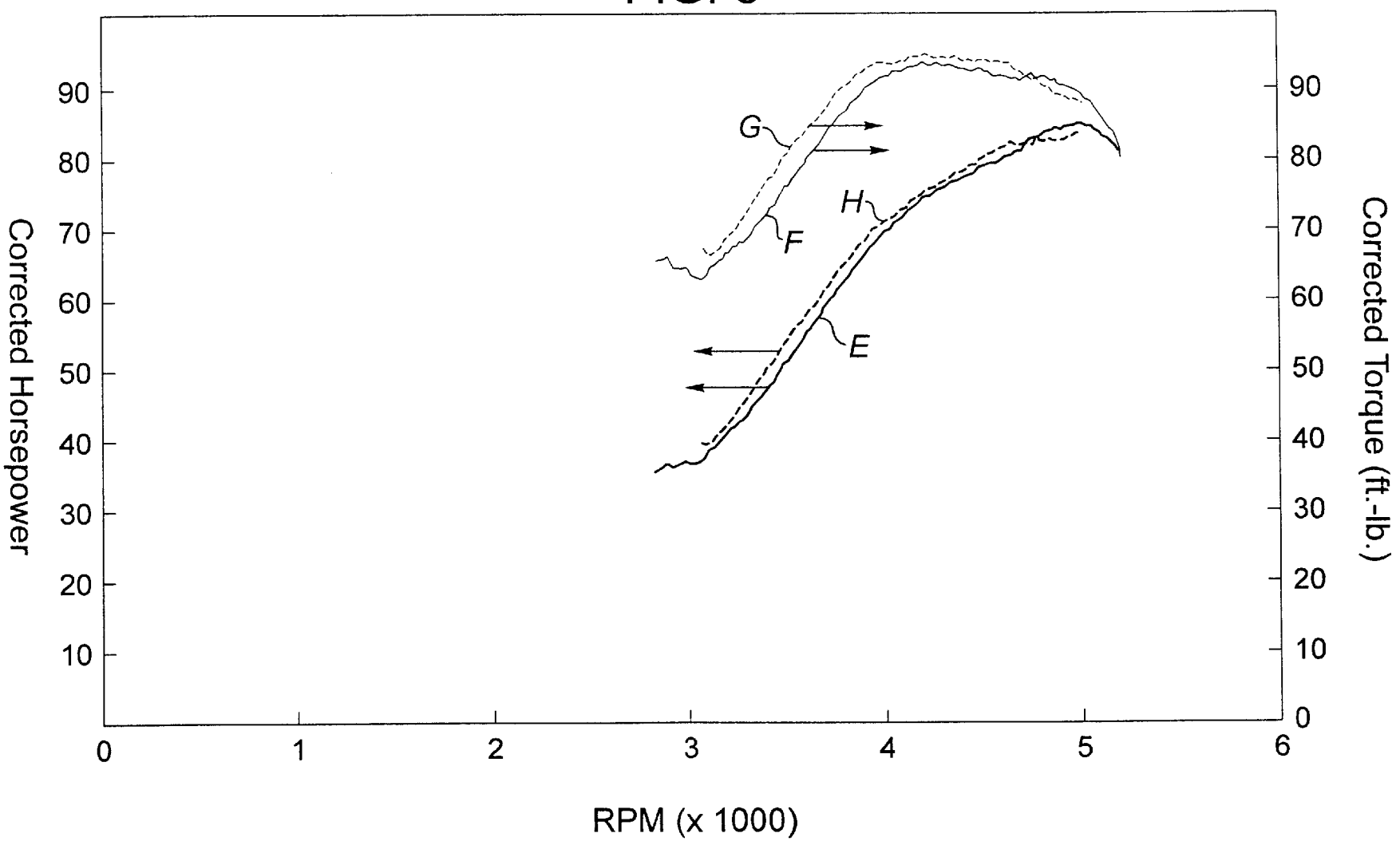
FIG. 5 is a chart illustrating the horsepower and torque output versus engine rpm for a post-1993 Harley engine, with and without the apparatus of FIG. 3 installed.

Referring to FIG. 5, lines E and F illustrate the horsepower and torque performance, respectively, of the first, conventional engine arrangement. Lines G and H represent the respective horsepower and torque for the second arrangement implementing the present invention.

Reflecting on the horsepower results, smaller yet measurable gains were obtained in horsepower (about 5%) at the lower end. Performance became substantially the same at engines speeds approaching 4000 rpm. Torque was also improved at the 3000 to 4000 rpm range; in the order of 5%. It is hypothesized that the lesser improvement is due in part to the pre-existence of a conventional one-way valve and bypass bleed hole. The slight improvement in performance using the novel valve can be attributed to better pressure management than could be achieved with the one-way valve and bleed hole.

Various modifications are apparent to those skilled in the art. For instance, variances in the materials of manufacture of the valve head will clearly affect the gap used. Further, use of a reed-type valve, spaced above a seal seat and being enclosed within a housing, can be seen to provide an equivalent valve in these instances.

The embodiments of the invention in which an exclusive property or privilege is claimed are defined as follows:

1. A crankcase ventilation system for an internal combustion engine having a crankcase defining a volume containing gases and having two or more cylinders extending from the crankcase, the bores of the cylinders being contiguous with the crankcase, the cylinders having two or more pistons movable therein, the system comprising:

pistons which move simultaneously inwardly and simultaneously outwardly from the crankcase during one piston cycle of normal engine operation, so that when moving inwardly, the volume of crankcase is caused to decrease with a resulting increase in pressure, and when moving outwardly, the volume of the crankcase is increased with a resulting decrease in pressure;

a breather hose having one end connected to the crankcase for flowing gases between the crankcase and atmosphere; and valve means located within the breather hose, said valve means being operative between three modes during one piston cycle, firstly to release buildup of pressure in the crankcase which becomes positive, being pressure greater than atmospheric, by flowing gas out of the crankcase, through the breather hose and through the valve means, secondly to permit a small amount of gas to flow into the crankcase through the breather hose and valve means as the pressure in the crankcase changes from positive to negative, and thirdly to block further ingress of gas into the crankcase as the pressure continues to become more negative so that pressure in the crankcase becomes negative.

2. The crankcase ventilation system as recited in claim 1, wherein the valve means comprise:

a housing having a passageway formed therethrough, said passageway having a inlet end and an outlet end;

a valve chamber formed in the passageway intermediate the inlet and outlet ends, said valve chamber having a inlet port which communicates with the inlet end and a outlet port communicating with the outlet end;

a valve seat formed at the inlet port; and a resilient member which is spaced above the valve seat to form a gap and being operable between the three modes as follows, in the first mode, gas flows from the inlet end and past the resilient member to the outlet end, in the second mode, a small amount of gas flows from the outlet end, through the gap and to the inlet end, and in the third mode, the flow of gas from the second mode causing the resilient member to flex and seal against the valve seat, preventing any further flow of gas from the outlet end to the inlet end.

3. The crankcase ventilation system as recited in claim 2, wherein the member is a resilient umbrella-shaped disk.

4. The crankcase ventilation system as recited in claim 3, wherein the member is manufactured of nitrile.

5. The crankcase ventilation system as recited in claim 4, wherein the gap between the nitrile member and the valve seat is in the range of 0.76 mm and 1.14 mm.

6. The crankcase ventilation system as recited in claim 2, wherein, the valve seat comprises a center boss having a central bore with an array of holes distributed therearound, the holes communicating with the inlet end of the passageway and forming the inlet port, the resilient member comprising a mushroom-shaped disk having a center stem, the center stem being fitted into the bore of the center boss so that the disk covers the array of holes, and the boss and stem cooperating to suspend the disk above the holes so as to form a gap between the valve seat and the disk through which gas can flow.

7. The crankcase ventilation system as recited in claim 2, wherein the member is a resilient reed-like strip.

8. The crankcase ventilation system as recited in claim 4 or 7 wherein the valve seat comprises a circular array of holes communicating with the inlet end of the passageway and forming the inlet port, the area circumscribed by the ports being smaller than the resilient member.

9. The crankcase ventilation system as recited in claims 3, 6 or 7 wherein the engine is a Harley Davidson motorcycle engine.

10. A crankcase breather valve for an internal combustion engine having a crankcase defining a volume containing gases and having two or more cylinders extending from the crankcase, the bores of the cylinders being contiguous with the crankcase, the cylinders having two or more pistons movable therein, the pistons moving simultaneously inwardly and simultaneously outwardly from the crankcase during one piston cycle of normal engine operation, so that when moving inwardly, the volume of crankcase is caused to decrease with a resulting increase in pressure, and when moving outwardly, the volume of the crankcase is increased with a resulting decrease in pressure, and a breather hose having one end connected to the crankcase for flowing gases between the crankcase and atmosphere, the breather valve being inserted into the breather hose, comprising:

a housing having a passageway formed therethrough, said passageway having a inlet end connected to the breather hose leading from the crankcase and having an outlet end;

a valve chamber formed in the passageway intermediate the inlet and outlet ends, said valve chamber having a inlet port which communicates with the inlet end and a outlet port communicating with the outlet end;

a valve seat formed at the inlet port; and a resilient member which is spaced above the valve seat to form a gap and being operable between the three modes as follows, in the first mode, gas flows from the inlet end and past the resilient member to the outlet end, in the second mode, a small amount of gas flows from the outlet end, through the gap and to the inlet end, and in the third mode, the flow of gas from the second mode causing the resilient member to flex and seal against the valve seat, preventing any further flow of gas from the outlet end to the inlet end.

11. The crankcase ventilation system as recited in claim 10, wherein the member is a resilient umbrella-shaped disk.

12. The crankcase ventilation system as recited in claim 11, wherein the member is manufactured of nitrile.

13. The crankcase ventilation system as recited in claim 12, wherein the gap between the nitrile member and the valve seat is in the range of 0.76 mm and 1.14 mm.

14. The crankcase ventilation system as recited in claim 13 wherein the engine is a Harley Davidson motorcycle engine.

* * * * *